United States Patent [19]

Brechbühl

[11] 4,112,796

[45] Sep. 12, 1978

[54] CUTTER APPARATUS FOR DIVIDING A FORM BAND OR THE LIKE INTO INDIVIDUAL FORMS

[75] Inventor: Heinz Brechbühl, Oberdiessbach, Switzerland

[73] Assignee: Maschinenfabrik Kern AG Konolfingen, Konolfingen, Switzerland

[21] Appl. No.: 829,869

[22] Filed: Sep. 1, 1977

[30] Foreign Application Priority Data

Sep. 7, 1976 [CH] Switzerland ..... 011331/76

[51] Int. Cl.[2] ..... B26D 7/18

[52] U.S. Cl. ..... 83/141; 83/620

[58] Field of Search ..... 83/133, 141, 620, 599, 83/136–140, 123–128

[56] References Cited

U.S. PATENT DOCUMENTS

| | | | |
|---|---|---|---|
| 834,887 | 11/1906 | Calhoun | 83/141 X |
| 1,050,436 | 1/1913 | Edison | 83/136 X |
| 1,495,806 | 5/1924 | Rudolphi | 83/620 |
| 2,475,807 | 7/1949 | Smith | 83/133 X |
| 3,039,343 | 6/1962 | Richards | 83/622 X |
| 3,308,699 | 3/1967 | Illingworth et al. | 83/599 X |
| 3,803,968 | 4/1974 | Black | 83/620 |

*Primary Examiner*—J. M. Meister

*Attorney, Agent, or Firm*—Werner W. Kleeman

[57] ABSTRACT

A cutter apparatus for dividing a form band or the like into individual forms, comprising two stationary cutters or knives and a movable cutter beam. The movable cutter beam possesses two knife or cutter edges at both marginal regions of the lower one of its two narrow sides. These cutter or knife edges, during each cutting stroke of the cutter beam, cut-out from the form band a transverse strip. At least one ejector element is mounted to be freely movable between two end or terminal positions at the cutter beam in a direction disposed essentially at right angles to said lower narrow side of the cutter beam. In particular, the ejector element can freely move between an inner terminal position in which it is dispositioned completely within the cutter beam and an outer terminal position in which an end portion of said ejector element which neighbors the aforesaid lower narrow side protrudes therefrom, in such a manner that during a rapid return stroke the ejector element which is then exposed to the action of inertia detaches the just-cut transverse strip from the cutter beam.

2 Claims, 2 Drawing Figures

CUTTER APPARATUS FOR DIVIDING A FORM BAND OR THE LIKE INTO INDIVIDUAL FORMS

BACKGROUND OF THE INVENTION

The present invention relates to a new and improved construction of a cutter apparatus for dividing a form band or the like into individual forms.

Form bands are employed, among other fields of use, in data processing machines as information carriers. They typically possess transversely extending weakened lines, so that prior to use, but also at intermediate stations of the data processing machines, they can be stacked in a zig-zag formation. The final division of the form band into individual forms, which for instance, should be shipped in a final state in envelopes or the like, as is known is not accomplished by carrying out individual cuts, rather by means of cuts carried out along two transverse lines spaced approximately 6 mm from one another, the two cuts being applied at opposite sides of the weakened line. This technique of resorting to the use of two cuts is preferred, because a single cut, which must be performed exactly along the weakened line, unnecessarily requires extreme accuracy in the cutting operation.

It has been found that the transverse strips which are formed when carrying out such cuts do not tend to simply drop down between the stationary cutters or knives, rather strive to so-to-speak "stick" at the lower narrow side of the cutter beam located between the cutter or knife edges, but then are stripped off from such narrow side by the subsequent form. These transverse strips which tend to migrate along with the form easily can lead to disturbances in the operation of the equipment and are prone to being undesirably packaged together with the sent forms.

SUMMARY OF THE INVENTION

Therefore, with the foregoing in mind, it is a primary object of the present invention to provide a new and improved construction of cutter apparatus for dividing a form band or the like into individual forms, in a manner not associated with the drawbacks and limitations of the prior art proposals.

Another and more specific object of the present invention aims at the provision of a new and improved construction of cutter apparatus which is designed such that the formed transverse strips are prevented from directly, following the formation thereof, "sticking" to the cutter beam as it moves through its return stroke and thereby arrive at the path of travel of the form, by means of which they are then entrained.

Tests carried out for the purpose of fulfilling these objectives while resorting to the aid of compressed air or suction devices, have not been successful when tried by applicant, quite to the contrary numerous difficulties arose in achieving any effective detachment of the cut transverse strips from the cutter beam.

The cutter apparatus of the present invention which is useful for subdividing or cutting a form band or the like into individual forms, comprises two stationary cutters or knives and a movable cutter or knife beam. The movable cutter beam has two cutter or knife edges located at both marginal regions or edges of the lower one of its two narrow sides, these cutter edges cutting-out of the form band a transverse strip during each cutting stroke of such cutter beam. According to important aspects of the present invention, which allows for completely reliable operation of the cutter apparatus notwithstanding the simple means which are used to realize the objectives of the invention, reside in the fact that at least one ejector element is mounted to be freely movable in the cutter beam between two end or terminal positions in a direction which is disposed essentially at right angles to the lower narrow side of the cutter beam. More specifically, such ejector element is movable between an inner end or terminal position where it is disposed completely within the cutter beam, and an outer terminal position where an end portion of such ejector element and which neighbors the aforesaid lower narrow side of the cutter beam protrudes therefrom, in such a manner that during a rapid return stroke the ejector element is subjected to the action of inertia forces which effectively detach the just-cut transverse strip from the cutter beam.

A transverse strip which once has been detached from the cutter beam readily falls, under the action of the force of gravity, between the stationary cutters or knives, thereby arriving at a collecting container provided in readiness for this purpose.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figures 1, 2:
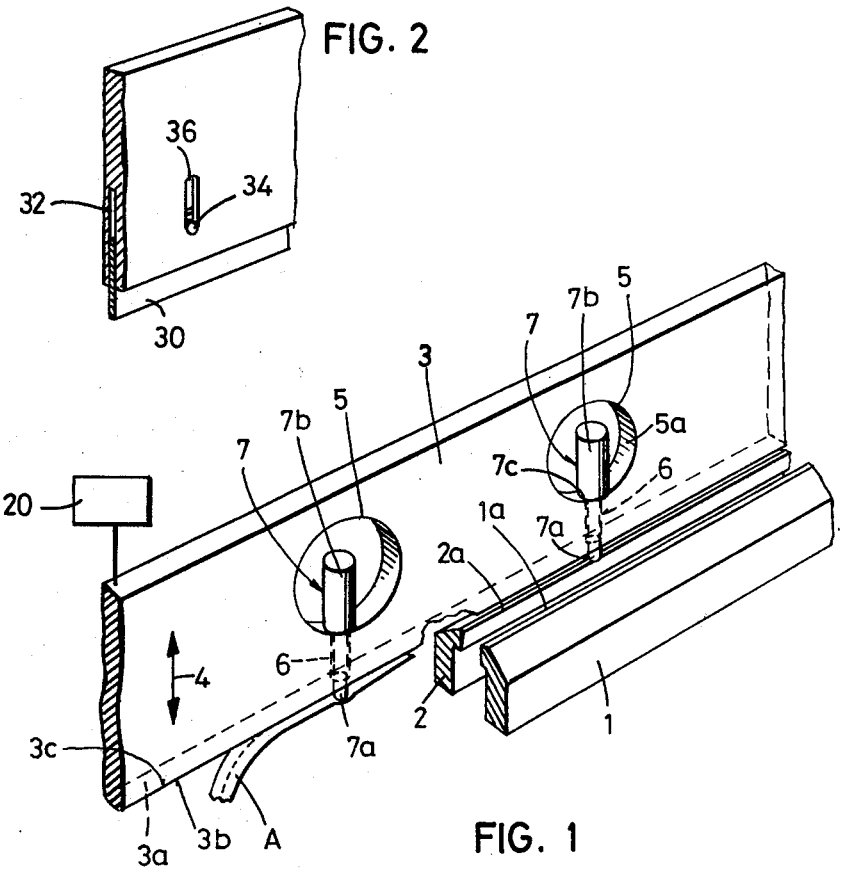
FIG. 1 illustrates a preferred exemplary embodiment of the cutter apparatus constructed according to the teachings of the present invention, shown in perspective view and partially in sectional view.
FIG. 2 is a fragmentary sectional view showing a modified construction of the cutter beam and useful in the arrangement of FIG. 1.

Describing now the drawings, it is to be understood that only enough of the construction of the cutter apparatus will be illustrated and discussed to enable those skilled in the art to readily understand the underlying concepts of the present invention.

Turning attention therefore to the showing of FIG. 1, the exemplary embodiment of cutter apparatus depicted therein will be seen to comprise two stationary cutters or knives 1 and 2 having the cutting edges 1*a* and 2*a*, respectively. Reference character 3 designates a cutter or knife beam which can be moved in the direction of the double-headed arrow 4 in any convenient manner, for instance manually, or preferably by a suitable, conventional drive, schematically indicated by reference character 20. The cutter beam 3 is provided at its marginal regions or edges with the knife or cutter edges 3*a* and 3*b* at its lower narrow side 3*c*.

Cutter beam 3 is equipped with the usual, circular-shaped openings or holes 5, serving to reduce the inertia mass, while taking into account the fact that the cutter beam 3 should be moved rapidly up and down, in other words, exposed to considerable acceleration and deceleration forces.

With the illustrated preferred exemplary embodiment of FIG. 1 there extend between each hole or cut-out 5 and the narrow side 3*c* of the cutter beam 3 a bore or passage 6 in which there is freely movably guided the thinner lower part 7*a* of an ejector bolt 7 or equivalent structure. The thicker upper portion 7*b* of each such ejector bolt 7 is located in an associated one of the cut-outs or holes 5. The length of both bolt parts or sections *7a, 7b* are dimensioned such that when the ejector bolts 7, as illustrated in the showing of FIG. 1, bear by means of the shoulder *7c* which is located between both parts *7a, 7b* of the related ejector bolt 7 upon the part of the wall *5a* of the hole 5 surrounding the upper not particularly referenced mouth of the related bore 6, the lowermost bolt section *7a* protrudes out of the bore 6 a distance corresponding to several millimeters, but this bolt section *7a* is however located completely within the related bore 6 when the ejector bolt 7 bears with its upper end at the wall of the associated cut-out or hole 5.

It should be readily understood that there can be arranged over the length of the cutter beam 3, in distributed fashion, a number of such cut-outs or holes 5 and ejector bolts 7.

During operation of the illustrated cutter apparatus, the transverse strip A formed during a cutting stroke still remains adhering to the narrow side *3c* of the cutter beam 3 as long as such cutter beam moves downwardly, and each ejector bolt 7 namely assumes its lower end position with regard to the cutter beam 3 under the effect of the inertia forces. Now if the return stroke (upward stroke) of the cutter beam 3 is initiated and such is assumed to be rapidly carried out, then the ejector bolts 7, under the action of the inertia, initially remain stationary. Thus, their lower end sections or portions *7a* move out of the associated bore 6 and thus detach the transverse strip A, as illustrated in FIG. 1, from the narrow side *3c* of the cutter beam 3. This transverse strip A, after completion of its detachment, can readily fall between the stationary cutter or knives 1 and 2.

In order to facilitate the insertion of the part or section *7a* of each ejector bolt 7 into the bore 6 during the assembly thereof, it is advantageous to fabricate at least this part out of plastic, so that it is flexible. It then can be introduced from the side of the hole 5 into the related bore 6. In the event that the bolt-upper portion *7b* consists of metal, then it can be pressed or screwed onto an upper projection of the bolt part or section *7a*.

Finally, according to a further variant construction of the invention as shown in FIG. 2 it would be possible to provide only a single ejector element, here depicted in the form of a ledge 30 which is arranged to be freely movable in a longitudinal groove 32 of the cutter beam 3 at the lower narrow side *3c* thereof. This ledge 30 is freely movable between two end or terminal positions with regard to the cutter beam 3. The end positions can be fixed by transverse pins 34 or the like which are inserted into the ledge 30 and can be arranged to be movable in elongate holes 36 provided at the cutter beam, or in openings or holes, such as the holes 5 of the cutter beam shown in FIG. 1.

While there are shown and described present preferred embodiments of the invention, it is to be distinctly understood that the invention is not limited thereto, but may be otherwise variously embodied and practiced within the scope of the following claims.

What I claim is:

1. A cutter apparatus for dividing a form band or the like into individual forms, comprising:

two stationary cutters:

a movable cutter beam coacting with said two stationary cutters;

said movable cutter beam having a lower narrow side equipped at both marginal regions thereof with two cutter edges which cut out of the form band a transverse strip during each cutting stroke of said cutter beam;

at least one ejector element comprising an ejector bolt freely movably mounted at the cutter beam between two terminal positions and disposed essentially perpendicular to said narrow side of said cutter beam;

said ejector element being movably between an inner terminal position in which said ejector element is located completely within the cutter beam and an outer terminal position in which an end region of the ejector element neighboring the narrow side of the cutter beam protrudes therefrom, in such a manner that during a rapid return stroke of the cutter beam away from said two stationary cutters the ejector element subjected to the action of inertia detaches a transverse strip from the cutter beam which has just been cut out of the form band;

said cutter beam possesses a number of transverse holes distributed over its length;

each said ejector bolt being arranged to cooperate with a related one of said holes;

said cutter beam possessing a respective bore merging with each said hole;

each ejector bolt having a thicker upper portion freely movable within a related one of the holes and a lower portion guided in a bore of the related hole of the cutter beam; and each said lower portion including the end region of the ejector element acting upon the cutoff transverse strip.

2. The cutter apparatus as defined in claim 1, wherein:

the lower portion of each ejector bolt is formed of flexible plastic in such a manner that during the assembly thereof from the side of a hole of the cutter beam such ejector bolt can be guidably introduced into the related bore thereof.

* * * * *